US008516664B2

(12) United States Patent
Gauthier et al.

(10) Patent No.: US 8,516,664 B2
(45) Date of Patent: Aug. 27, 2013

(54) CUFFLINK

(75) Inventors: Romain Gauthier, Le Brassus (CH); Thomas Ciciulla, Orny (CH)

(73) Assignee: Montres Romain Gauthier SA, Le Sentier (CH)

( * ) Notice: Subject to any disclaimer, the term of this patent is extended or adjusted under 35 U.S.C. 154(b) by 121 days.

(21) Appl. No.: 13/318,717

(22) PCT Filed: Apr. 28, 2010

(86) PCT No.: PCT/IB2010/051865
§ 371 (c)(1), (2), (4) Date: Nov. 3, 2011

(87) PCT Pub. No.: WO2010/128434
PCT Pub. Date: Nov. 11, 2010

(65) Prior Publication Data

US 2012/0047689 A1 Mar. 1, 2012

(30) Foreign Application Priority Data

May 5, 2009 (CH) ..... 0703/09

(51) Int. Cl.
*A44B 5/00* (2006.01)

(52) U.S. Cl.
USPC ..... 24/102 SL; 24/99; 24/100

(58) Field of Classification Search
USPC ..... 24/99, 100, 102 SL
See application file for complete search history.

(56) References Cited

U.S. PATENT DOCUMENTS

| | | | | |
|---|---|---|---|---|
| 87,262 | A * | 2/1869 | Jefferson | 24/99 |
| 136,166 | A * | 2/1873 | Kent | 24/99 |
| 300,551 | A * | 6/1884 | Adams | 24/99 |
| 324,302 | A | 8/1885 | Conard | |

(Continued)

FOREIGN PATENT DOCUMENTS

| | | |
|---|---|---|
| DE | 13925 | 9/1880 |
| DE | 27443 | 10/1883 |
| DE | 69517 | 12/1892 |
| GB | 601181 A | 4/1948 |

OTHER PUBLICATIONS

International Preliminary Report on Patentability (English translation), issued by the International Bureau, Geneva, Switzerland, dated Nov. 9, 2011, for International application No. PCT/IB2010/051865; 7 pages.

(Continued)

*Primary Examiner* — Robert J Sandy
*Assistant Examiner* — David Upchurch
(74) *Attorney, Agent, or Firm* — Faegre Baker Daniels LLP

(57) ABSTRACT

A cufflink including a head portion with a bearing surface for bearing against a garment, a pin portion to be inserted through a hole or a slot of the garment, and a clasp portion with at least one pivotable tab for locking the cufflink onto the garment. The cufflink includes an actuator with a shaft slidably mounted in a housing and including a push button at one end and an actuation arm at the other end which is inserted into an actuation portion of the tab (so as to pivot the tab from an unlocked position into a locked position when the push button is pressed. The cufflink further includes a locking-unlocking mechanism with push buttons arranged on either side of the shaft of the actuator, wherein the push buttons can be accessed from the opposite sides of the side wall.

10 Claims, 5 Drawing Sheets

(56) References Cited

U.S. PATENT DOCUMENTS

Figure 1A:
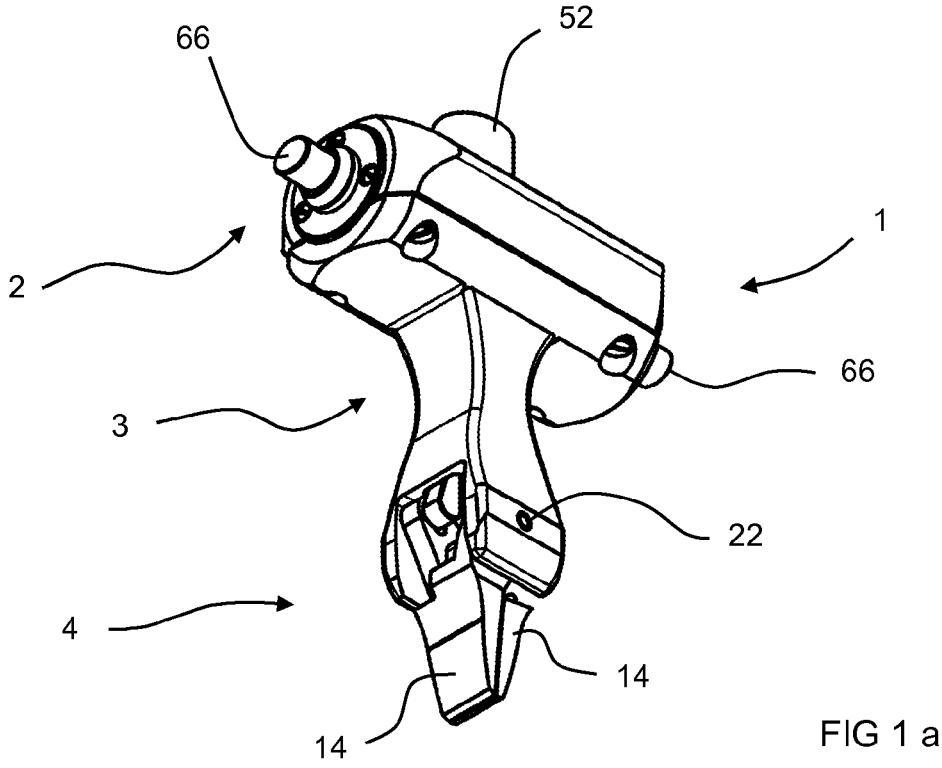

| | | | | | |
|---|---|---|---|---|---|
| 327,768 | A | * | 10/1885 | Conrad | 24/99 |
| 327,906 | A | * | 10/1885 | Veit | 24/99 |
| 327,907 | A | * | 10/1885 | Veit | 24/99 |
| 378,956 | A | * | 3/1888 | Frenot | 24/99 |
| 407,643 | A | | 7/1889 | Dittmann | |
| 476,362 | A | | 6/1892 | Breisch | |
| 1,348,985 | A | * | 8/1920 | Evans | 24/99 |
| 1,621,570 | A | | 3/1927 | Williams | |
| 2,461,845 | A | * | 2/1949 | Osterberg | 24/100 |
| 2,501,151 | A | * | 3/1950 | Bayardi | 24/97 |
| 4,062,089 | A | * | 12/1977 | Vinczer | 24/97 |
| 5,412,848 | A | | 5/1995 | Precourt, Jr. | |

OTHER PUBLICATIONS

International Search Report issued by the European Patent Office, Rijswijk, Netherlands, dated Aug. 12, 2010, for International Application No. PCT/IB2010/051865; 3 pages.

English translation of the International Search Report issued by the European Patent Office, Rijswijk, Netherlands, dated Aug. 12, 2010, for International Application No. PCT/IB2010/051865; 2 pages.

* cited by examiner

CUFFLINK

The present invention relates to a garment button having an operable clasp, such as a cufflink.

A cufflink is a fashion accessory which allows the sleeve of a shirt to be closed when it has only slots in the cuff. Most known cufflinks include a decorative head part, a pin part and at the other end a clasp part in the form of an arm that pivots from a position aligned with the pin, so as to be able to insert the pin through the slots, to a position orthogonal to the pin to anchor the pin to the sleeve. A bistable spring and positioning system allows the arm of the clasp system to be held in the "locked" and "unlocked" positions. Manual rotation of the clasp arm is difficult to carry out, the user having only one hand available for locking and unlocking. Among other things, it can happen that the cufflink becomes unhooked if the clasp snags involuntarily on an object or that an end of the arm is in the slot in the garment, allowing the clasp to rotate to the unlocked position.

In order to facilitate the insertion of buttons through the slots in garments, other solutions with spring-loaded clasps have been disclosed such as those described in U.S. Pat. No. 407,643, U.S. Pat. No. 1,621,570, U.S. Pat. No. 5,412,848, U.S. Pat. No. 3,243,02, U.S. Pat. No. 4,763,62, U.S. Pat. No. 3,279,06, DE13925, DE 27443, and DE 69517.

The various spring-loaded systems proposed are still quite difficult to manipulate, to insert and to remove with one hand and/or can still be inadvertently unlocked quite easily.

An object of the invention is to provide a garment button which is easy to insert and to lock, and which is difficult to detach inadvertently. It is advantageous to provide a garment button which is easy to remove.

It is advantageous to provide a garment button with a robust clasp system that is easy to lock and unlock and which is compact.

The garment button can in particular be a cufflink.

Objects of the invention are achieved by the garment button according to Claim 1.

Disclosed herein is a garment button comprising a head part with a bearing surface designed to rest against a garment, a pin part designed to be inserted through a hole or a slot in the garment, and a clasp part with at least one pivotable tab designed to lock the button to the garment. The button includes an actuator with a shaft slidably mounted in a housing of the button, the actuator comprising a pushbutton at one end, and an operating arm toward the other end engaging with an actuation part of a pivoting tab of the clasp part. Displacement of the actuator causes the tab to pivot from a position aligned with the pin part ("unlocked position") to a locked position when the pushbutton is pushed.

The locking-unlocking mechanism includes at least one locking arm with a locking finger configured to engage with a complementary locking element on the actuator shaft when the tab of the clasp part is in the locked position. The mechanism can include a pushbutton extending through a side wall of the housing with a spring pushing the locking arm into the locked position. Preferably, the locking-unlocking mechanism includes two locking arms arranged on either side of the actuator shaft, the pushbuttons being accessible from the opposite sides of the side wall, configured to be squeezed between the thumb and the index finger of a user for unlocking and removing the garment button. Unlocking is therefore automatic and results from a natural grasping of the button by the user.

Advantageously, the garment button according to the invention can be inserted and removed very easily, particularly with only one hand.

The locking-unlocking mechanism can advantageously have teeth or protuberances on the locking fingers to provide a threshold of resistance against involuntary unlocking.

Preferably the clasp part includes a pair of tabs pivoting in opposite directions about a common pivot. Each of the tabs comprises an actuation part arranged offset to a lateral side of the tab so that the actuation parts of the pair of tabs overlap.

The actuating end of the actuator includes cam elements, in the form of protuberances for example, cooperating with cam elements, in the form of slots for example, on the actuating extension of the respective tabs.

Figure 1B:
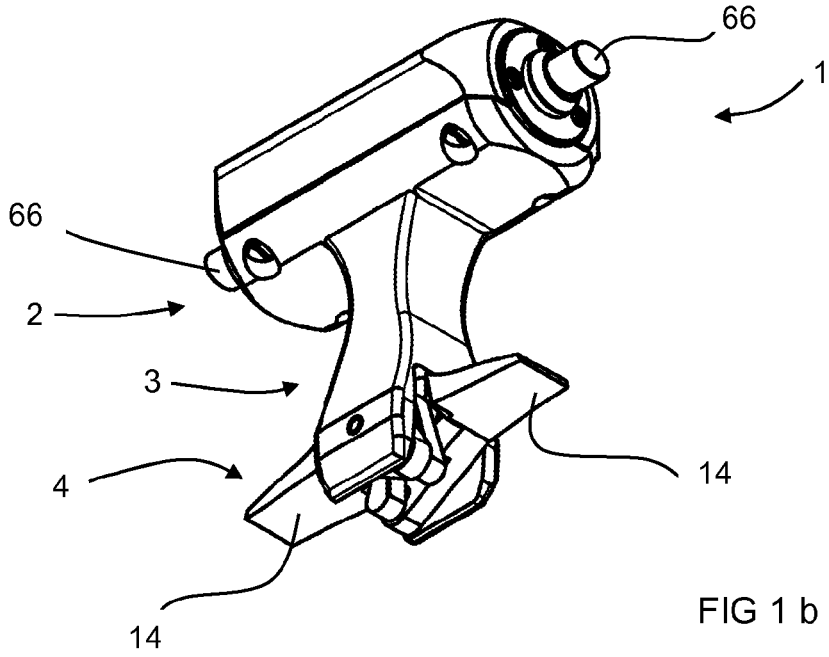
Figure 2:
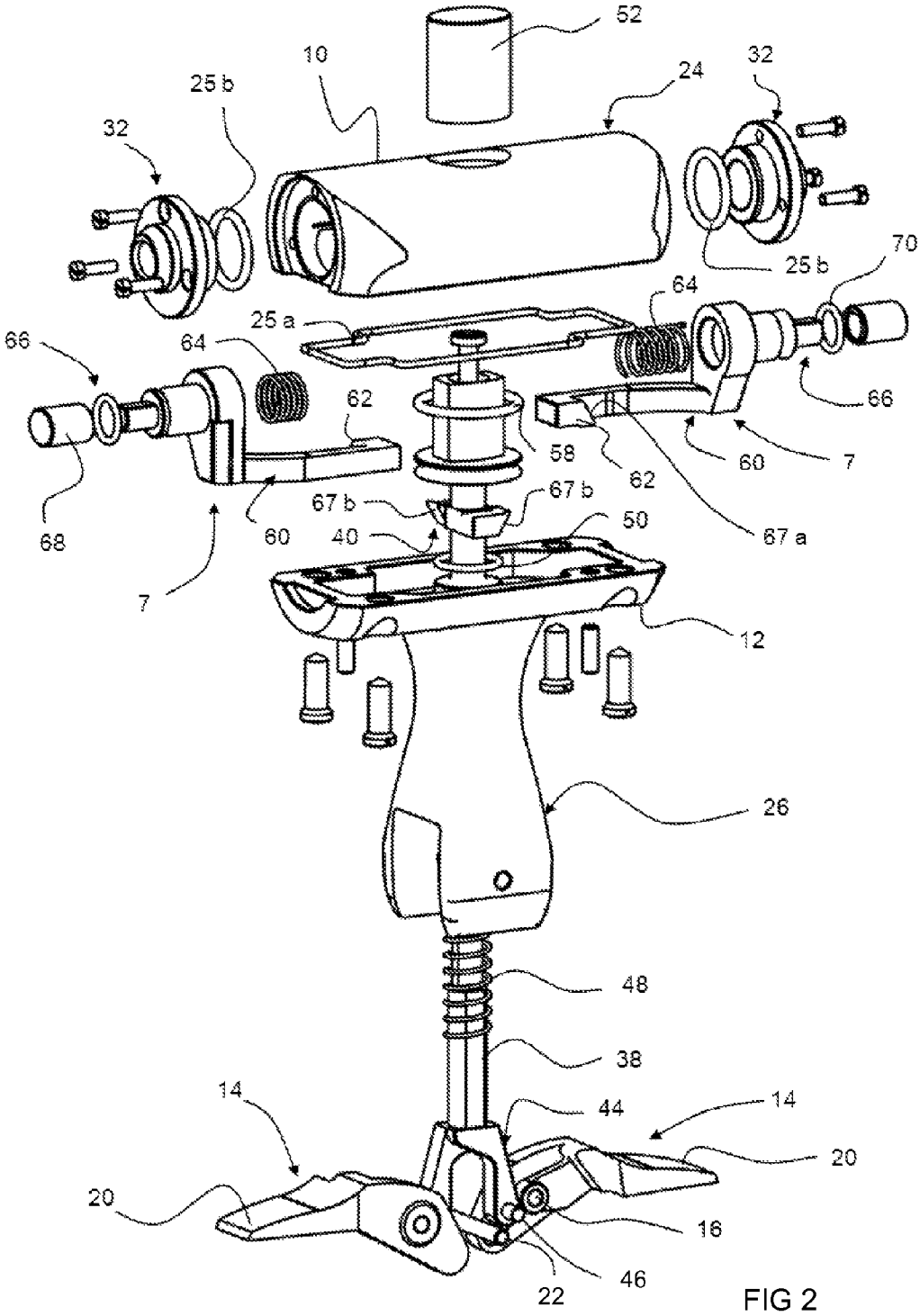

Other advantageous aims and aspects of the invention will appear from the claims, from the detailed description of an embodiment hereafter and from the appended drawings, wherein:

FIG. 1*a* is a perspective view of a garment button according to an embodiment of the invention, with the clasp in the unlocked position (ready to be inserted);

FIG. 1*b* is a perspective view of the embodiment according to FIG. 1*a*, but with the clasp in the locked position;

FIG. 2 is an exploded perspective view of the embodiment according to FIGS. 1*a*, 1*b;*

Figure 3A:
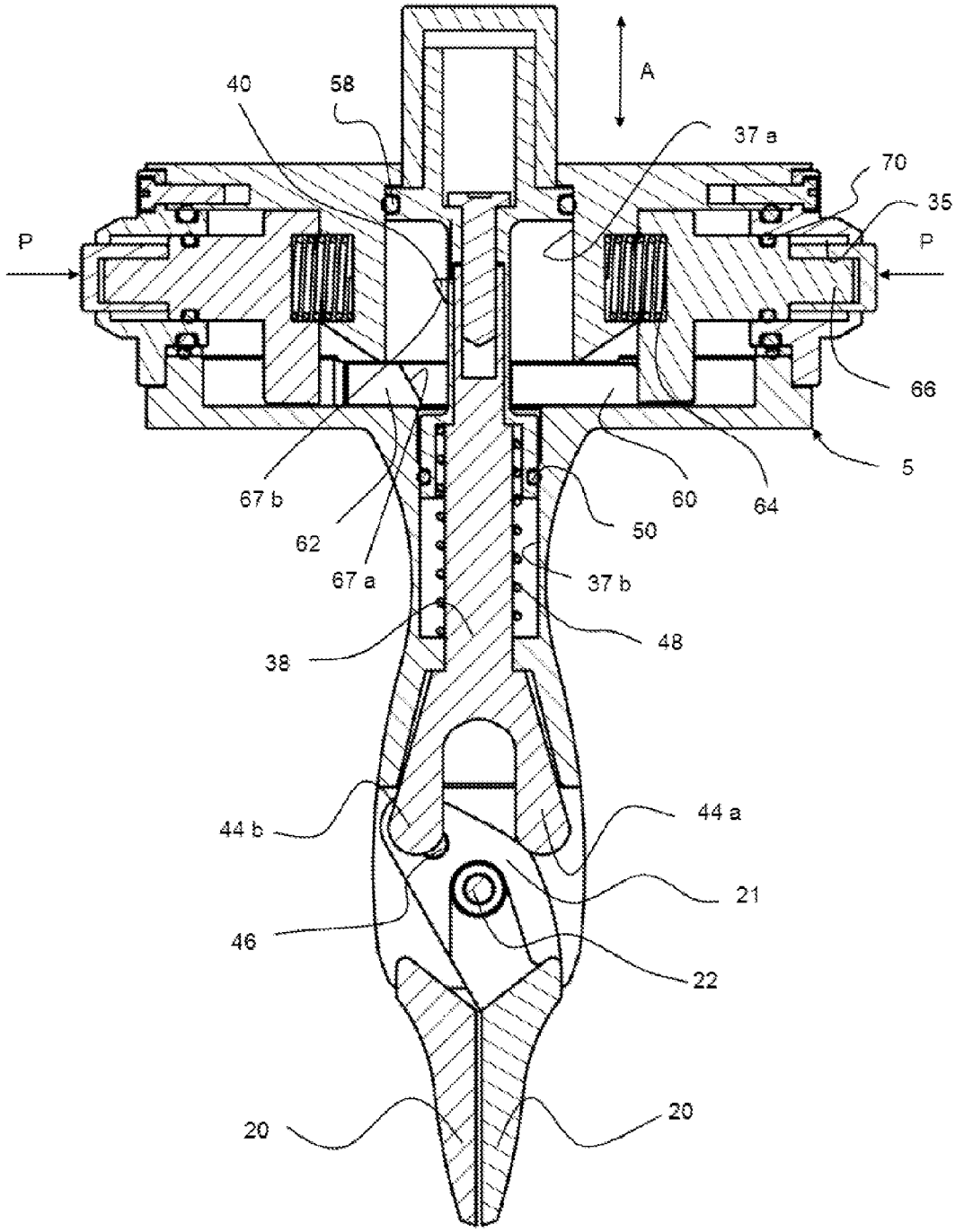
Figure 3B:
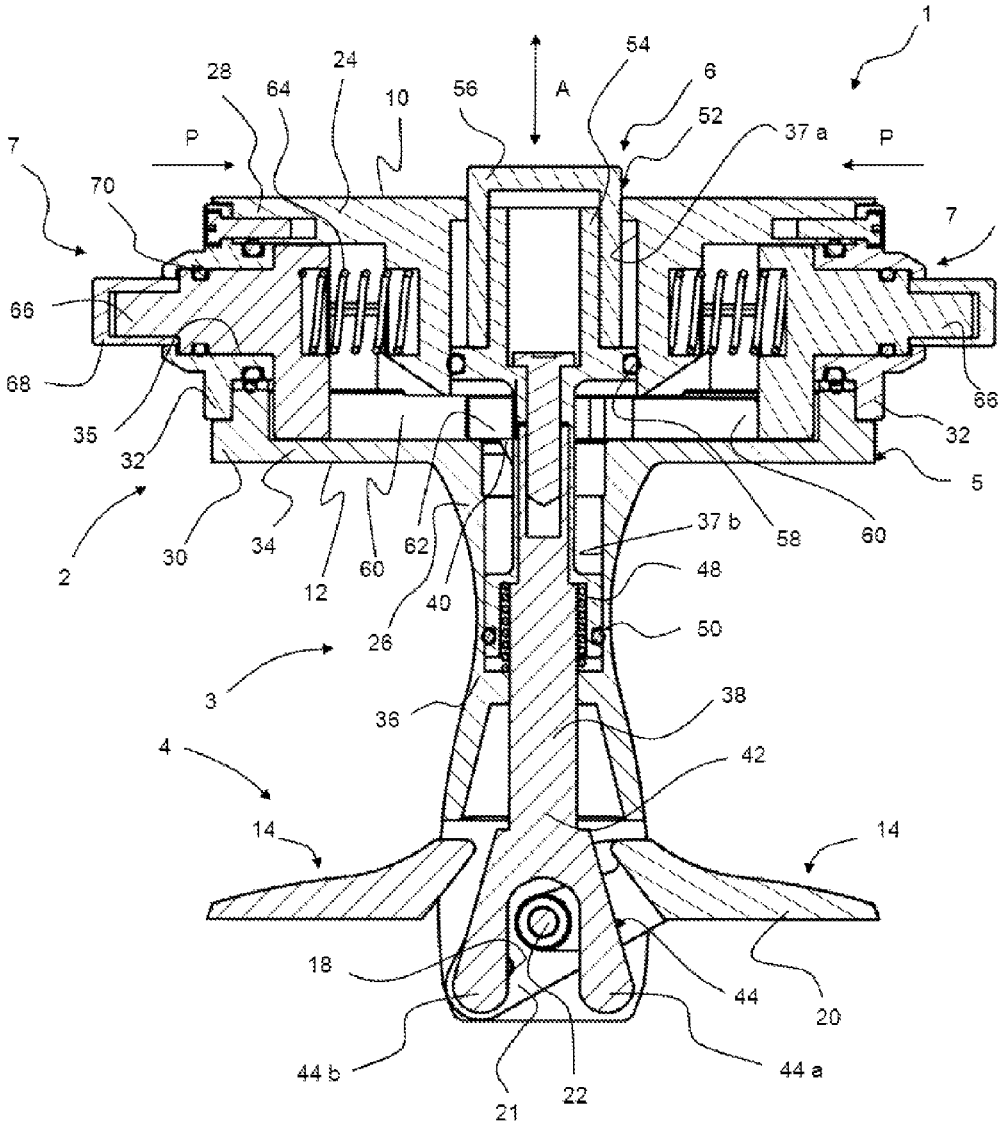
Figure 4:
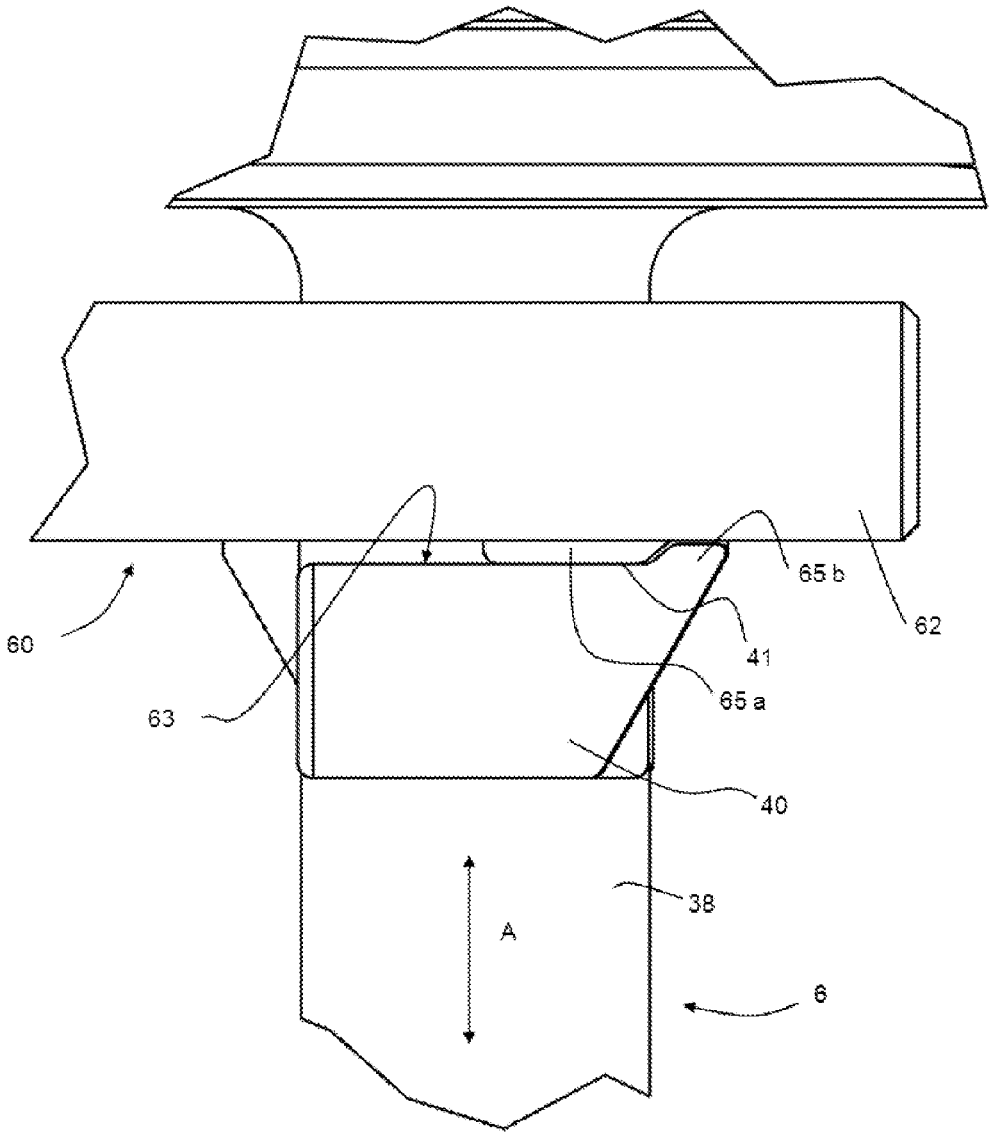

FIG. 3*a* is a plan section view of an embodiment of a button according to the invention, with the clasp in the unlocked position;

FIG. 3*b* is a section view similar to FIG. 3*a* but with the clasp in the locked position;

FIG. 4 is a detail view of part of a locking-unlocking mechanism of the clasp.

Referring to the figures, a garment button 1 includes a head part 2, a pin part 3 and a clasp part 4. The head part includes a bearing surface 12 designed to be placed against a surface of a garment, and opposite it an upper or display surface which can be decorative or provided with a decorative element. The pin part 3 creates the connection between the head part 2 and the clasp part 4 and is designed to pass through a hole or slot in one or more layers of a garment, while the clasp part is designed to engage with the other side of the layer or layers of the garment so that it will be held between the clasp part and the bearing surface of the head part.

The garment button includes a housing 5, an actuator 6 and a locking-unlocking mechanism 7.

The housing 5 includes, in the illustrated embodiment, at least two separate parts—an upper casing 24 and a lower casing 26—which allow the assembly of components of the actuator and of the locking-unlocking mechanism inside the housing. The upper wall 28 of the housing can integrally include or constitute the display surface 10, or can be designed to as to be able to attach a decorative element such as a decorative disk, a jewel or other decorative element on the display surface. The side wall 30 of the housing includes passages 33 through the side wall to allow positioning, guiding and access to the pushbuttons 66 of the locking-unlocking mechanism 7. The side wall 30 can include annular inserts 32 allowing the assembly and retention of the pushbuttons in the housing. The inserts can also include guide surfaces 35, for example in the form of a cylindrical cavity for guiding the pushbuttons in linear sliding motion. The housing includes a lower wall 34 opposite the upper walls and forming the bearing surface 12. The housing also includes a pin wall 36 forming a tube for guiding a shaft 38 of the actuator 6 slidably mounted in the wall of the pin.

At the end of the pin wall 36 of the housing 5 is arranged the clasp part 4 including one or more tabs 14 pivotably assembled to the housing. The tabs 14 are mounted on a pivot 22 in the form of a cylindrical shaft attached at its ends to the pin wall 36 and running through the interior of the tube formed by the pin wall. Each tab 14 therefore includes a passage forming a pivot journal 16 and, extending therefrom, a clasp arm 20. The clasp arm can be pivoted from a position substantially aligned with the shaft 38 of the actuator 6 and of the central passage of the pin wall 36, as illustrated in FIGS. 1*a* and 3*a* (unlocked position) to a position essentially orthogonal to this first position, as illustrated in FIGS. 1*b* and 3*b* (locked position). The tab 14 thus includes an actuation part 21 in the form of an extension extending from the pivot 22 in the direction opposite to the clasp arm, this actuation part including a cam 18. The cam 18 can for example be in the form of a slot, engaging with a complementary cam 46, for example in the form of a cylindrical shaft, of the actuator 6. The extensions are arranged with an offset toward a lateral side of the clasp arm such that the actuation parts of the pair of tabs overlap and can pivot with respect to one another about the pivot 22.

The actuator 6 includes a central shaft 38 which can be made in one or more parts, a return spring 48 for pushing the shaft back from a locking position such as that illustrated in FIG. 3*b* to an unlocked position such as that illustrated in FIG. 3*a*, and a pushbutton 52 extending through the upper wall 28 of the housing so as to be accessible from the display surface 10. Seals 50, 58, for example in the form of O-rings, are mounted between the shaft 38 and guide surfaces 37*a*, 37*b* corresponding to the interior of the housing for guiding the shaft in linear motion in an axial direction A within the housing.

The shaft 38 of the actuator includes the locking element 40 having one or more locking shoulders cooperating with one or more locking fingers 62 of the locking-unlocking mechanism 7. The locking finger 62 on the locking arm 60, and the locking element 40 on the shaft 38 of the actuator 6 can advantageously include oblique surfaces 67*a*, 67*b* constituting cam surfaces for driving the linear displacement of the arms 60 toward one another (in the direction P) when the actuator is pushed from the unlocked position toward its unlocked position.

The actuator 6 also includes an actuation end 42 including actuation arms 44 provided with the cams 46 (in the form of protuberances for example) engaging with the cams 18 (in the form of slots for example) of the tabs. Thus, when the actuation shaft is displaced from an unlocked position, corresponding to a high position as illustrated in FIGS. 1*a*, 3*a*, to a locked position, corresponding to a low position as illustrated in FIGS. 1*b*, 3*b*, the cams 46 at the end of the actuator engaged in the cams 18 of the tabs cause the tabs to pivot about the pivot 22 from the unlocked position to the locked position. The cooperating cams 18, 46 can have other shapes and other configurations, for example the tabs may be provided with a cam in the form of a protuberance that is engaged in a cam in the form of a slot in the actuation arms of the actuator.

The locking-unlocking mechanism 7 includes locking arms 60 attached to the pushbuttons 66 which extend through the side walls of the housing, and springs 64 pushing the locking arms into their locking position where the locking finger 62 on the locking arms engages with the complementary locking element 40 on the shaft 38 of the actuator 6. The locking shoulders 63, 41 can have complementary shapes, for example in the form of protuberances 65*a*, 65*b* or of teeth which mesh in the locked position as illustrated in FIG. 4. This is to create a resistance by means of an obstacle against unlocking of the mechanism, particularly to act as a brake against inadvertent unlocking when one of the pushbuttons 66 is involuntarily pressed. Only a certain pressure on both pushbuttons allows the tabs to be unlocked and pivoted into the unlocked position as illustrated in FIGS. 1*a* and 3*a*.

It is possible to have only one locking arm for locking the shaft; however, a pair of locking arms offers additional locking security and natural actuation for the user who presses the buttons on either side with the thumb and index finger to withdraw the button from the garment.

In the embodiment illustrated, the locking arms overlap and are arranged on either side of the central shaft 38 in order to allow the locking finger 62 to move away from the locking element 40 on the actuator when the pushbutton 66 is pushed in the direction P of the shaft 38. The locking arms and the pushbuttons 66 can be provided with seals 70, for example in the form of O-rings bearing on the guide surfaces 35 in the form of cylindrical cavities in the side wall 30 of the housing, particularly in the annular insert 32.

The various seals make it possible to hermetically close the housing and to prevent fouling of the operating and locking-unlocking mechanism. Seals 25*a*, 25*b* may be provided between the various parts 24, 26, 32 of the housing at the interfaces in order to seal the interior of the housing. The seals 50, 70 on the movable elements also serve to guide displacement of the components with a braking effect, that is to say with a damping effect on the motion of the components, in order to achieve gentle, jerk-free motion.

The pushbuttons 66 can be equipped with caps 68, 56 that are decorative or simply functional. The cap 56 of the pushbutton 62 of the actuation system can be bonded to a decorative disk or other decorative element constituting the visual and decorative element of the button, for example of a cuff-link. Alternatively, the cap 56 of the pushbutton 52 can be part of a decorative element on the decorative surface 10, being configured so as to either be flush with the decorative surface or slightly depressed or slightly projecting with respect to that surface to give a decorative effect according to the wishes of the designer of the decorative part of the button.

The clasp part can include a single tab or a single extension arranged asymmetrically with respect to the shaft 38 of the pin part. It can also be contemplated within the scope of the invention to have a pivoting tab with a second arm extending from the actuation part 21, of symmetrical or asymmetrical shape with respect to the arm 20 extending on the other side of the pivot 22. In such an embodiment, when the button is in the unlocked position, one of the arms is therefore positioned aligned with and adjacent to the pin part 2 of the button.

The spring of the actuator may be a coil spring as illustrated in the figures, or may be of any other type of spring or of elastic system applying a force returning the actuator toward its unlocked position. This spring can for example be a circular or spiral spring surrounding the pivot 22 applying a rotational force to the tab or tabs 14. The springs of the locking-unlocking mechanism can be coil springs as illustrated in the figures, but can also include other types of springs applying an elastic force to the pushbuttons 66 in the locked position. The spring can be positioned between two parts of the locking arms (that is directly between them) rather than between each locking arm and the housing.

In the embodiment illustrated, the locking-unlocking mechanism carries out a linear motion; however, it can also be contemplated within the scope of the invention to have arms that are pivoting or guided by a non-straight rail or cavity in order to carry out a rotational movement with or without translation to disengage the locking finger from the locking element located on the actuator.

LIST OF ELEMENTS LABELED IN THE FIGURES

| List of elements labeled in the figures | |
|---|---|
| 1 | garment button |
| 2 | head part |
| 10 | (decorative) display surface |
| 12 | bearing surface |
| 3 | pin part |
| 4 | clasp part |
| 14 | tabs |
| 16 | pivot journal |
| 18 | cam (for ex. in the form of a slot) |
| 20 | clasp arm |
| 21 | actuation part |
| 22 | pivot |
| 5 | housing |
| 24 | upper casing |
| 37a | guide surface (cavity) |
| 26 | lower casing |
| 25a, 25b | seals |
| 28 | upper wall |
| 30 | side wall |
| 32 | annular insert (for button guidance and stop) |
| 33 | passages |
| 35 | guide surface |
| 34 | lower wall |
| 36 | pin wall (shaft guide tube) |
| 37b | guide surface (cavity) |
| 6 | actuator |
| 38 | shaft |
| 40 | locking element |
| 41 | locking shoulder |
| 65b | protuberance |
| 67b | oblique (cam) surface |
| 42 | actuating end |
| 44a, 44b | actuation arm |
| 46 | cam (e.g. in the form of a cylindrical shaft) |
| 48 | return spring |
| 50 | seal |
| 52 | pushbutton (for engaging the clasp) |
| 54 | body |
| 56 | cap |
| 58 | seals |
| 7 | locking-unlocking mechanism |
| 60 | locking arm |
| 62 | locking finger |
| 63 | locking shoulder |
| 65a | protuberance |
| 67a | oblique (cam) surface |
| 64 | spring |
| 66 | pushbutton (for unlocking the clasp) |
| 68 | cap |
| 70 | seal |

The invention claimed is:

1. A garment button comprising a head part with a bearing surface designed to bear against a garment, a pin part designed to be inserted through a hole or a slot in the garment, and a clasp part with at least one pivotable tab designed to lock the button to the garment, the button including an actuator with a shaft slidably mounted within a housing of the button and including a pushbutton at one end and an actuation arm toward the other end engaging with an actuation part of the tab to pivot the tab from an unlocked position to a locked position when the pushbutton is pressed, the garment button further comprising a locking-unlocking mechanism including at least one locking arm with a locking finger configured to engage with a complementary locking element on the shaft of the actuator when the tab of the clasp part is in the locked position.

2. A garment button according claim 1, wherein the locking-unlocking mechanism includes a spring and a pushbutton, the pushbutton extending through a side wall of the housing, the spring pushing the locking arm into a locked position.

3. A garment button according claim 2, wherein the locking-unlocking mechanism includes two locking arms, each with a pushbutton, arranged on either side of the shaft of the actuator, the pushbuttons being accessible from the opposite sides of the side wall.

4. A garment button according to claim 1, wherein the locking element and the locking finger of the shaft of the actuator, respectively, of the locking arm of the locking-unlocking mechanism include interlocked teeth or protuberances constituting a threshold of resistance against involuntary unlocking.

5. A garment button according to claim 1, wherein the clasp part includes a pair of tabs pivoting in opposite directions.

6. A garment button according claim 5, characterized in that the pair of tabs pivots about a pivot in the form of a common shaft, the shaft being attached to the housing at its ends.

7. A garment button according to claim 6, wherein the tabs each include an actuation part arranged with an offset to a lateral side of the tab so that the actuation parts of the pair of tabs overlap.

8. A garment button according to claim 1, wherein the actuating end of the actuator includes a pair of actuation arms, each with a cam element cooperating respectively with a cam element on the actuation extension of the respective tabs.

9. A garment button according to claim 8, wherein the cam on the tab is in the form of a slot and the cam of the actuator is in the form of a protuberance engaging with the slot.

10. A garment button according to claim 1, wherein the actuator and the pushbuttons of the locking-unlocking mechanism include seals sealing off the interior of the housing.

* * * * *